US006262653B1

(12) United States Patent
Pietriferno

(10) Patent No.: US 6,262,653 B1
(45) Date of Patent: Jul. 17, 2001

(54) LIGHT FLASHING APPARATUS

(76) Inventor: Umberto Pietriferno, 206 Notre-Dame, Sainte-Adele, P.Q. (CA), J0R 1L0

( * ) Notice: Subject to any disclaimer, the term of this patent is extended or adjusted under 35 U.S.C. 154(b) by 0 days.

(21) Appl. No.: 09/376,313

(22) Filed: Aug. 18, 1999

(51) Int. Cl.[7] ..... G08B 1/00

(52) U.S. Cl. ..... 340/331; 340/332; 340/815.48; 307/15; 307/132 E

(58) Field of Search ..... 340/331, 332, 340/815.01, 815.47, 815.48, 815.8, 310.06, 310.08; 379/39, 37; 362/46, 806; 307/113, 112, 115, 132 E

(56) References Cited

U.S. PATENT DOCUMENTS

| | | | | |
|---|---|---|---|---|
| 4,556,863 | | 12/1985 | Devitt et al. | 200/310 |
| 4,836,823 | * | 6/1989 | Laven | 446/485 |
| 4,983,960 | | 1/1991 | Dunn | 340/825.17 |
| 5,270,698 | | 12/1993 | Hoyle et al. | 340/825.17 |
| 5,521,578 | * | 5/1996 | DelValle | 340/330 |
| 5,872,832 | * | 2/1999 | Bishel et al. | 379/39 |

* cited by examiner

*Primary Examiner*—Edward Lefkowitz
*Assistant Examiner*—Davetta W. Goins

(57) ABSTRACT

The light flashing apparatus of the present invention is a four-button control switch in conjunction with an electronic circuit which is installed within an existing light switch junction box and replaces conventional switches. In addition to the two conventional on and off modes of a light switch, the apparatus allows for two different flashing modes; slow and fast flashing of the same light. The selection of any of the four modes overwrites the previous mode of operation, thereby having only one operating mode at a time. Any operating mode is selected by pushing a corresponding one of the four buttons. The slow flashing mode is used, for example, to help someone find your address when there is no hurry (taxi, delivery and so on) while the fast flashing mode corresponds to an emergency situation. The fast flash mode may also be remotely activated by a radio frequency RF signal transmitter. The apparatus of the present invention also does not require any other external source of energy to be functional, other than the existing wiring system.

11 Claims, 4 Drawing Sheets

LIGHT FLASHING APPARATUS

FIELD OF THE INVENTION

The present invention relates to the field of switch apparatuses and more particularly to a switch apparatus that can flash one or more light(s) on and off continuously as well as turn said light(s) on and off conventionally, yet be installed using the existing wiring system of a house or other building.

BACKGROUND OF THE INVENTION

Finding an address for the first time is not always easy and it becomes even more difficult particularly at night. Therefore, it can be very helpful to have one or more light(s) such as porch light(s) or other outdoor light(s) which can be flashed on and off repeatedly in order to attract attention to one's house. For example, the present invention can be used to alert the neighbors that there is a danger situation within your house. It can also be used for guiding a firefighter truck, ambulance or police car to your house in an emergency, or for helping friends find your house when you are having a party.

U.S. Pat. No. 4,556,863 to Devitt et al, granted on Dec. 3, 1985, U.S. Pat. No. 4,983,960 to Dunn, granted on Jan. 8, 1991 and U.S. Pat. No. 5,270,698 to Hoyle et al, granted on Dec. 14, 1993 all show a light flashing device that uses a custom switch with the two conventional ON and OFF positions plus an additional third position to make the light flashing to signal to the outside an emergency situation or the like. These prior art devices to be installed in existing switch junction boxes of a house or building and using existing wiring system do provide only on flashing position. Neighbors or people passing by may get confused as to know if the flashing signal does highlight an emergency situation or simply a visual sign for someone specific to recognize, thus causing unwanted reactions from time to time.

OBJECTS OF THE INVENTION

It is an object of the present invention to provide a light flashing apparatus which obviates the above mentioned disadvantages and allows for two different flashing modes: slow and fast. The slow flashing mode is used, for example, to help someone find your address when there is no hurry (taxi, delivery and so on) while the fast flashing mode corresponds to an emergency situation.

It is another object of the present invention to provide a light flashing apparatus which, once connected into an existing switch junction box and to the existing wiring system of a house or other building, does not require any other external source of energy to be functional.

It is still another object of the present invention to provide a light flashing apparatus which is numerical and thus less sensible to the electronic noises than the emergency signaling devices of the prior art which are analog.

It is yet another object of the present invention to provide a light flashing apparatus which can be manufactured in several versions. A first version of the light flashing apparatus comes with a four-button control switch. It is installed within an existing light switch junction box and replaces conventional switches. Other versions of the light flashing apparatus can also be used in combination with different accessories like a remote control (panic button), a smoke detector, an alarm system (motion sensor, door/window transmitter) and so on in order to flash at least one outdoor light when an emergency situation happens. Every version of the light flashing apparatus can be connected to the existing electrical wiring system of a house or other building.

It is a further object of the present invention to provide a light flashing apparatus which will conform to convenient forms of manufacturing, be of simple construction and easy to use, as to provide a light flashing apparatus which will be economically feasible, long lasting and relatively trouble-free in operation.

SUMMARY OF THE INVENTION

The present invention consists of a switching apparatus for flashing a light fixture of a building, the light being connected by existing two-wire circuit to a source of a relatively high voltage AC current, the switching apparatus comprises:

- a switch housing mounted within a switch junction box within the interior of the building;
- a four-button control switch mounted to the housing, the switch having an "on" button, an "off" button, a "fast flash" button and a "slow flash" button, each of said buttons corresponding to a respective power state of said light;
- an electronic circuit mounted within the housing and electrically connected to the control switch, the electronic circuit being connected in series with the light, the electronic circuit providing a constant power state of the light upon selection of the "on" button, a no power state of the light upon selection of the "off" button, a fast on-and-off cycling power state of the light upon selection of the "fast flash" button, and a slow on-and-off cycling power state of the light upon selection of the "slow flash" button, said fast and slow on-and-off cycling power states having a first and a second predetermined high and low frequency respectively, selection of anyone of said buttons overwriting a previous selection, said electronic circuit enabling one of said four different power states of said light to be activated at a time upon selection of a corresponding one of said four buttons.

Preferably, the electronic circuit is comprised of a digital micro-controller controlling an electronic relay allowing for the power to flow to the light fixture depending on which of the buttons of the control switch is being selected, and an AC to DC converter power supply energizing the micro-controller, the power supply being connected to the existing two-wire circuit.

Preferably, each one of the four buttons of the control switch having an active connection and a ground connection, the micro-controller is an integrated circuit having four out of its eight pins electrically connected to the active connections of the four buttons, two pins connected to the power supply, one of the latter two being also connected to the ground connections of all four buttons, one pin connected to the electronic relay and one pin connected to a frequency reference, the integrated circuit producing at least two different frequencies corresponding to the predetermined high and low frequencies.

Preferably, the apparatus further comprises a remote means for transmitting an electromagnetic signal, the electronic circuit further comprises a receiver means adapted to be activated upon reception of the electromagnetic signal, the receiver means being electrically connected in parallel to one of the buttons.

Preferably, the electromagnetic signal is a radio frequency (RF) wave signal and the receiver means is electrically connected in parallel to the "fast flash" button.

Preferably, the electronic circuit being adapted to be connected to a plurality of external household electronic accessories all electrically connected in parallel to one of the buttons.

Alternatively, one of the external household electronic accessories is an alarm system and the system is electrically connected in parallel to the "fast flash" button.

Preferably, the control switch further has a plurality of additional buttons adapted for selecting a personal access code for comparison against a code programmed within the electronic circuit to enable possible activation of the apparatus upon activation of the system.

BRIEF DESCRIPTION OF THE DRAWINGS

In the annexed drawings, like reference characters indicate like elements throughout. An embodiment of the invention will now be described, by way of example, in reference to the following drawings in which.

DETAILED DESCRIPTION OF THE PREFERRED EMBODIMENT

Figure 1:
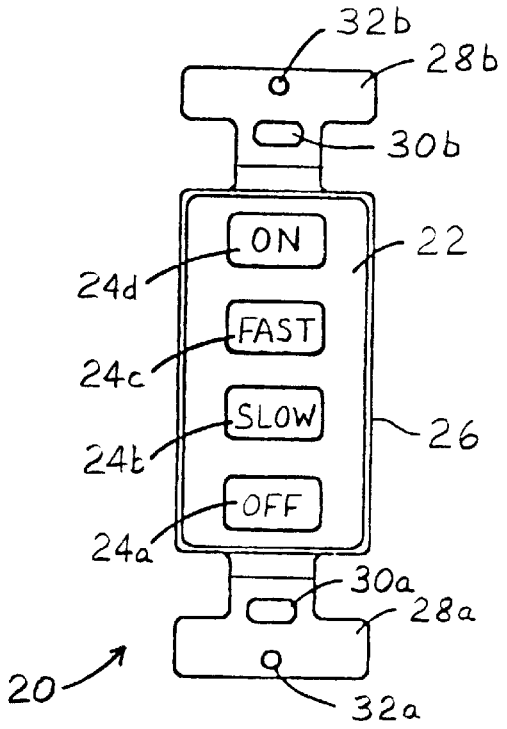
FIG. 1 is a front elevation view showing a light flashing apparatus in accordance with a first embodiment of the present invention.
Figure 2:
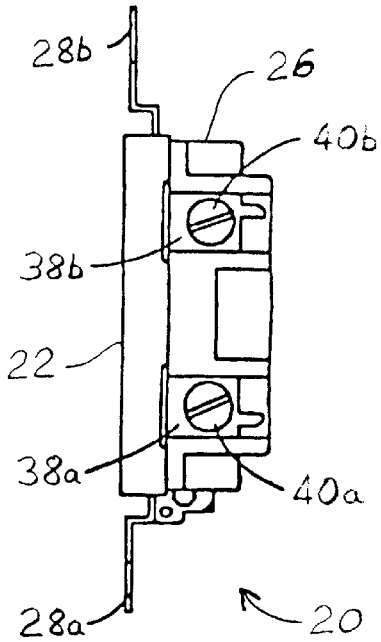
FIG. 2 is in a side view of the embodiment of FIG. 1.

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring to FIGS. 1 to 4, there is shown a first embodiment of the light flashing apparatus 20 of the present invention. The apparatus 20 includes a control switch 22 comprising four buttons 24*a*, 24*b*, 24*c* and 24*d* that can be operated by an operator and mounted on the switch housing 26. The four buttons correspond to the following modes: "off", "slow flash", "fast flash" and "on" respectively, the "ON" and "OFF" modes being identical to a conventional light switch. Preferably, as shown on FIG. 1, the words "OFF", "SLOW", "FAST" and "ON" appears on the buttons respectively. The housing 26 includes a first mounting bracket 28*a* and second mounting bracket 28*b* which comprise two holes 30*a*, 30*b* and two threaded holes 32*a*, 32*b* for the installation to an existing light switch junction box 34 and for the installation of a switch plate 36 respectively. The configuration and size of the light flashing apparatus 20 allows for its installation within a conventional light switch junction box 34, thus replacing the existing standard two-position switch (not shown). The first and second terminals 38*a* and 38*b* of said housing 26 simply have to be connected to the existing wiring system of a house H or other building with screws 40*a* and 40*b* (see electrical leads 39 and 40 of FIGS. 3 and 4). Furthermore, the light flashing apparatus 20 does not require new electrical installation or any other external source of energy to be functional.

Figure 3:
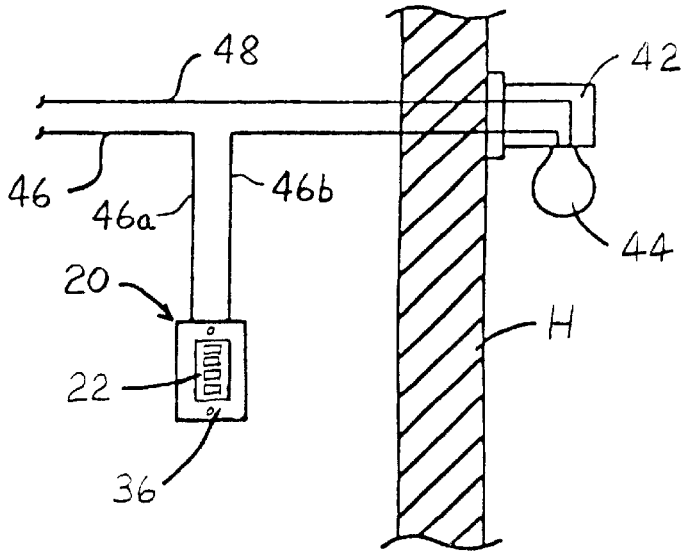
FIG. 3 is a schematic view showing a porch light mounted to a house or building exterior wall and the embodiment of FIG. 1 mounted in the pre-existing electrical circuit for the light fixture.

Referring to FIG. 3, there is shown in a schematic view, an exterior porch light fixture 42 mounted to a house or building wall W. The light bulb 44 of the fixture 42 is powered by conventional 120 volt 60 Hz AC household electrical current which is applied across first and second electrical leads 46 and 48. Mounted in lead 46, so as to control the passage of current therethrough, is the apparatus 20 of the preferred embodiment of the present invention.

Figure 4:
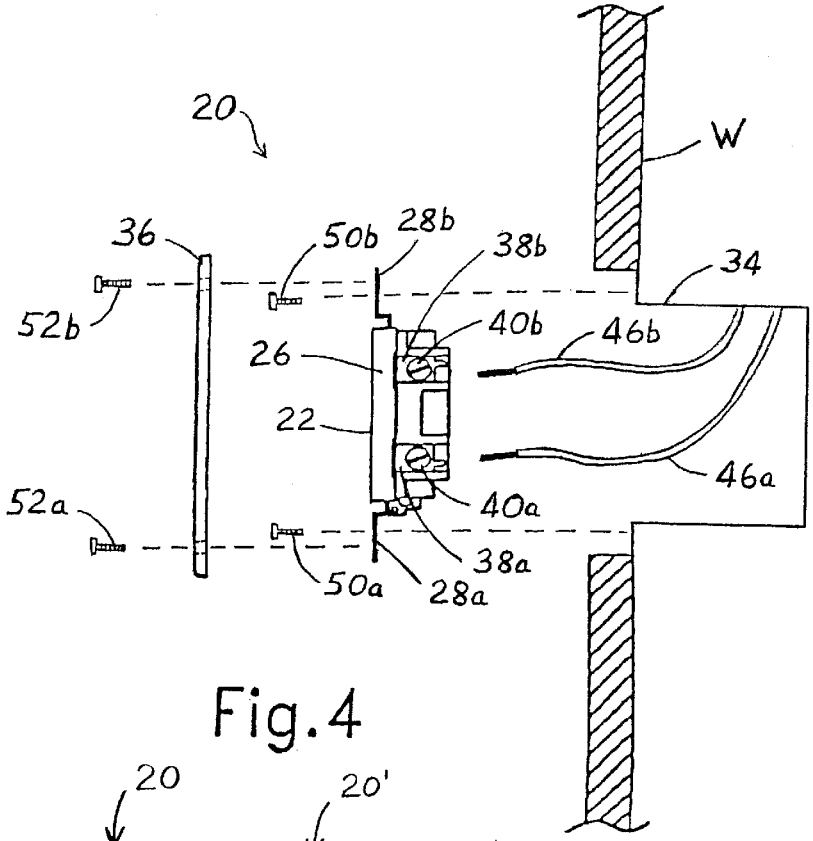
FIG. 4 is an exploded view, partially in cutaway, showing the installation of the embodiment of FIG. 1 to an existing light switch junction box recessed into a wall.

FIG. 4 shows how in installed the light flashing apparatus 20 to the existing switch junction box 34 recessed into the wall W of a house H. The apparatus 20 is connected in series to the light bulb 44 with the existing wiring system of the house H by securing the wire leads 46*a*, 46*b* to the terminals 38*a*, 38*b* using the screws 40*a*, 40*b* respectively. Once the installation is completed, the housing 26 of the apparatus 20 is inserted into the switch junction box 34 and secured in place with screws 50*a* and 50*b*. Finally, the switch plate 36 is installed over the apparatus 20 and secured to the housing 26 with screws 52*a* and 52*b*.

The housing 26 contains a printed circuit board 54 on which are mounted the different electronic components of the apparatus 20.

Figure 5:
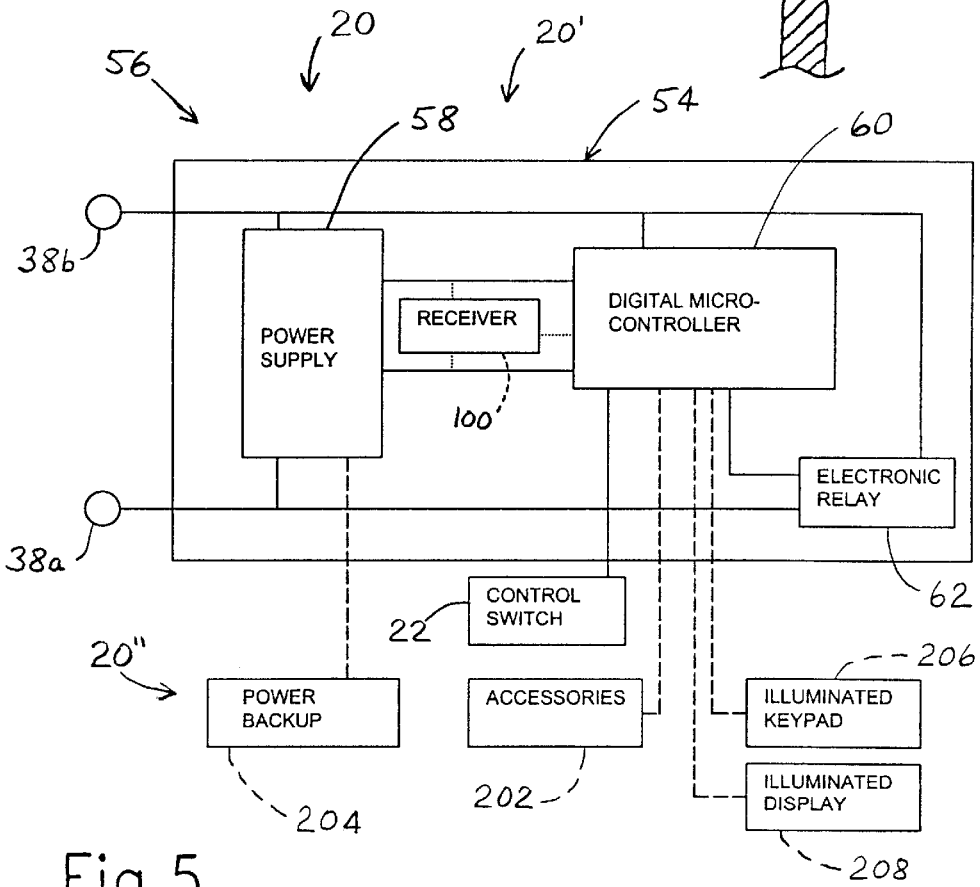
FIG. 5 shows a bloc diagram incorporating the embodiment of FIG. 1 in solid lines, a second embodiment in dotted lines and a third embodiment in dashed lines.

Referring to FIG. 5, the bloc diagram 56 of the printed circuit board includes a power supply 58 (HVAC to DC converter), a digital micro-controller 60 and an electronic relay 62. The power supply 58 is powered by the high voltage 120 volts 60 Hz AC household electrical current and provides stable DC current to the digital micro-controller 60 for the latter to properly function. The four buttons 24*a*, 24*b*, 24*c* and 24*d* of the control switch 22 are electrically connected to the micro-controller 60 and, depending of the button that is selected by the operator, the micro-controller sends the proper signal to the electronic relay 62 which controls the flow of the household HV AC current to the light fixture 42.

Figure 6:
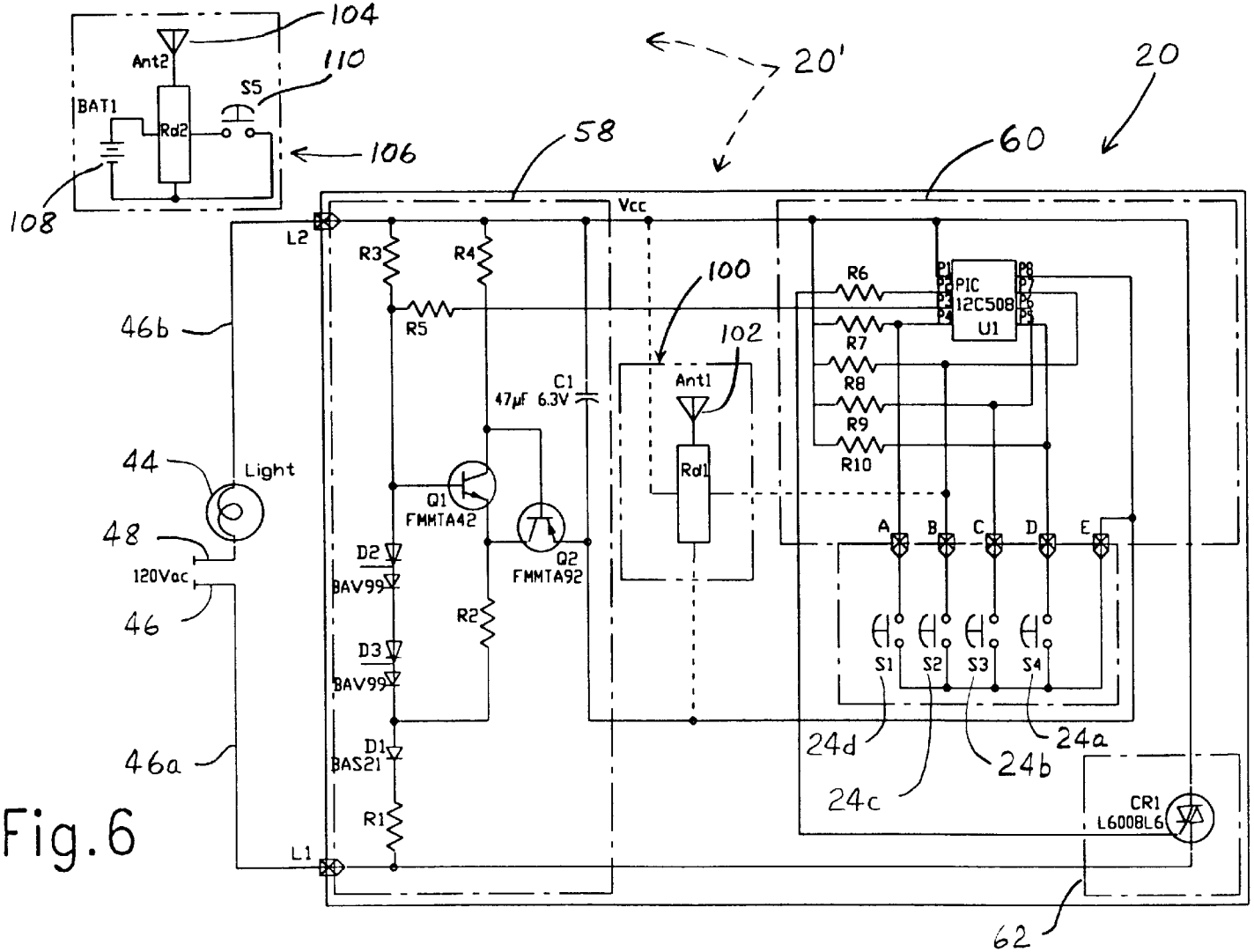
FIG. 6 shows a diagram of the embodiment of FIG. 1 implementing the block diagram of FIG. 5 in solid lines and the additional circuitry incorporated for a second embodiment of the present invention.

Referring to FIG. 6, there is shown the detailed electrical diagram of the printed circuit board 54. Power supply 58 includes three diodes D1, D2 and D3, five resistors R1, R2, R3, R4 and R5, two transistors Q1 and Q2 as well as a capacitor C1 ensuring a stable DC voltage output Vcc, preferably 12 Volts DC (could typically be chosen to be anywhere between 5 and 15 Volts DC), against the variable 120V AC current input and any short current surges generated by changes of operational modes by the operator. The digital micro-controller 60 is an integrated circuit (IC) U1, conventional eight pin PIC 12C508 for example, connected a resistor that is, more specifically R6 connected in series between pin P2 of the IC and the electronic relay 62, constituted of a conventional triac, CR1 L6008L6 for example. It also connects to four resistors R7, R8, R9 and R10, each connecting to one of the four main connection points A, B, C and D where the active side of the four switch buttons 24*d*, 24*c*, 24*b* and 24*a* and pins P4, P7, P6 and P5 of IC U1 are connected respectively. The ground side of all four switch buttons are connected to a fifth connection point E itself connected to the ground reference level of the power supply 58 and ground pin P8 of the IC U1. Pins P1 and P3 of IC U1 are connected to the reference DC voltage Vcc and reference frequency at resistor R5 of the power supply 58 respectively.

When either one of the two flashing mode buttons 24*b*, 24*c* are selected, the apparatus 20 operates such that the light fixture continuously flashes on-and-off until an other button 24*a*, 24*d* is selected. A slow flash mode is used, for example, to help someone find your address when there is no hurry (taxi, delivery and so on) while the fast flash mode may corresponds to an emergency situation happening inside the house H or building such as fire, theft, resident having a heart attack or the like.

In the case of an emergency situation such as a heart attack or any situation for which it is difficult, if not impossible, for the operator to reach the apparatus 20', a second embodiment of the present invention further includes a receiver 100 comprising a first antenna Ant1, 102 adapted to recognize a specific electromagnetic signal, preferably radio frequency (RF) wave signal, emitted by a remote second antenna 104 and electrically connected in parallel, preferably, to the "fast flash" button 24*c* link inside the micro-controller 60 (as shown in dotted lines in FIGS. 5 and 6). The remote antenna Ant2, 104 is connected to a transmitter 106, powered by its own source of energy 72, preferably a dry cell battery BAT1, and emits its signal upon activation of a single button switch 110, thus remotely activating "fast flash" mode of the apparatus 20'. The remote antenna 104 may be worn on the operator's wrist for easy access in case of emergency. It may also, for example, be integrated within the operator's watch and thereby sharing the battery of the watch.

Receiver 100 is connected to both ground reference level and DC reference voltage Vcc of power supply 58 as well as to pin P7 of IC U1 of micro-controller 60 for fast flash activation mode.

Figure 7:
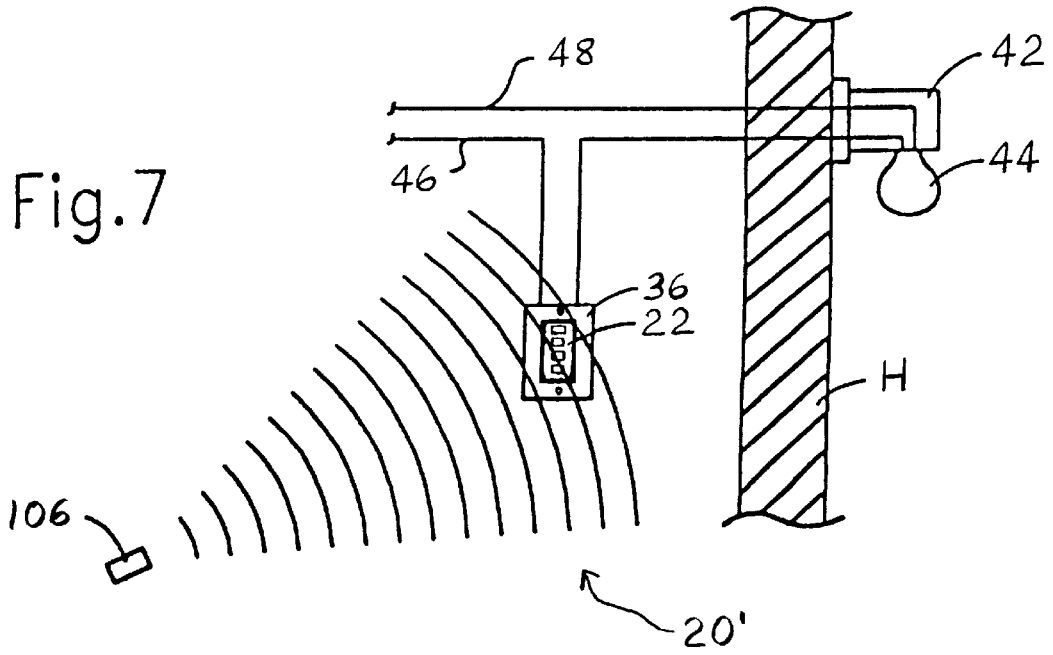
FIG. 7 is a schematic view similar to FIG. 3 showing a porch light mounted to a house or building exterior wall and a second embodiment outlined in FIG. 6 mounted in the pre-existing electrical circuit for the light fixture.

Referring to FIG. 7, there is shown in a schematic view, an exterior porch light fixture 42 mounted to a house or building wall W, similar to FIG. 3. Mounted in lead 46, so as to control the passage of current therethrough, is the apparatus 20' of the second embodiment of the present invention being remotely activated in "fast flash" mode by the remote transmitter 106.

Figure 8:
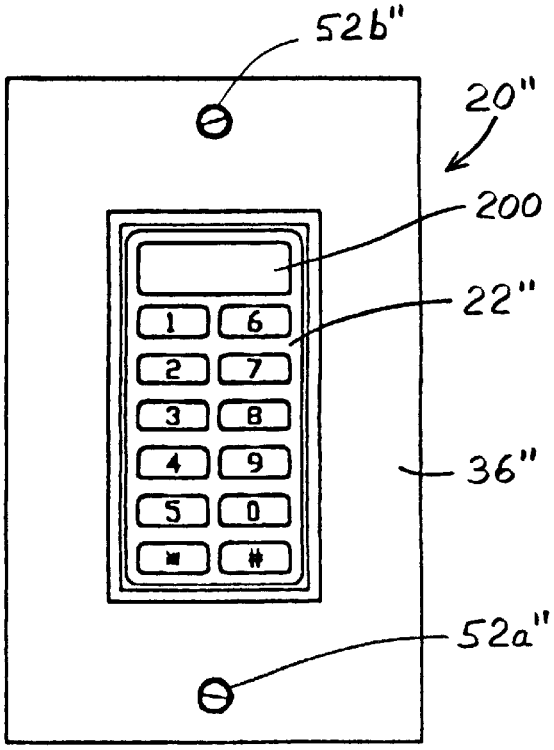
FIG. 8 is a view similar to FIG. 1 showing a third embodiment of the flashing apparatus of the present invention.

Referring to FIG. 8, there is shown a third embodiment of light flashing apparatus 20" the present invention. The light flashing apparatus 20" includes a control switch 22" comprising twelve different buttons 24" such as a numeric keypad (10 number buttons, a "*" button and a "#" button) and a display 200, a first and second terminals (not shown) and a switch plate 36" secured with screws 52*a* " and 52*b* ". The configuration and size of the light flashing apparatus 20" still allow to install it within a conventional light switch junction box 34, thus replacing the existing standard two-position switch (not shown). Once again, it simply has to be connected to the existing wiring system of a house or other building. Like the first two embodiments of the light flashing apparatus 20, 20', the third one 20" does not require any other external source of energy to be functional.

This third embodiment 20" comprises the control switch 22" by which an operator can select either to use the light flashing apparatus 20" as a conventional switch or to activate its flashing modes. To turn the light(s) on-and-off according to the four modes explained in other embodiments for example, the operator simply has to press on the "1", "2", "3" and "4" buttons. Several accessories 202 can be added to this third embodiment of the present invention. These accessories 202 can activate the light flashing apparatus 20" at distance (radio frequencies RF waves) to make one or more outdoor light(s) flash in case of an emergency. Said accessories 202 can be, for example, a remote transmitter as in second embodiment (panic button), a smoke detector, an alarm system (motion sensor, door/window transmitter), an automatic telephonic calling module, etc. Also, the numbered keypad of the light flashing apparatus 20" may be used to enter a personalized access code for the alarm system.

Referring back to FIG. 5, the dashed lines represent additional features present in the third embodiment 20" of the present invention. The configuration and functioning of the bloc diagram 56" is similar to the one above described for the first embodiment 20 with the exception that there are a few additional components connected to the initial printed circuit board 56 for the utilization of additional accessories 202 which can be used with said light flashing apparatus 20". These additional components are a power backup 204, such as dry cell batteries used in conventional calculators or the like, connected in parallel to the power supply 58, a radio frequency transmitter 106 and receiver 100, an illuminated keypad 206 and an illuminated display 208.

The different embodiments of the present invention herein above described could also be connected to additional flashing light(s) or strobe(s) which could be installed, for example, on the roof of a house or building for more visibility.

I claim:

1. A switching apparatus for flashing a light fixture of a building, said light being connected by existing two-wire circuit to a source of a relatively high voltage AC current, said switching apparatus comprising:

a switch housing mounted within a switch junction box within the interior of said building;

a four-button control switch mounted to said housing, said switch having an "on" button, an "off" button, a "fast flash" button and a "slow flash" button, each of said buttons corresponding to a respective power state of said light;

an electronic circuit mounted within said housing and electrically connected to said control switch, said electronic circuit being connected in series with said light, said electronic circuit providing a constant power state of said light upon selection of said "on" button, a no power state of said light upon selection of said "off" button, a fast on-and-off cycling power state of said light upon selection of said "fast flash" button, and a slow on-and-off cycling power state of said light upon selection of said "slow flash" button, said fast and slow on-and-off cycling power states having a first and a second predetermined high and low frequency respectively, selection of anyone of said buttons overwriting a previous selection, said electronic circuit enabling one of said four different power states of said light to be activated at a time upon selection of a corresponding one of said four buttons.

2. A switching apparatus as defined in claim 1, wherein said switch junction box is a conventional switch junction box used in most of buildings.

3. A switching apparatus as defined in claim 1, wherein said electronic circuit is comprised of a digital micro-controller controlling an electronic relay allowing for said power to flow to said light fixture depending on which of said buttons of said control switch is being selected, and an AC to DC converter power supply energizing said microcontroller, said power supply being connected to said existing two-wire circuit.

4. A switching apparatus as defined in claim 3, wherein each one of said four buttons of said control switch having an active connection and a ground connection, said microcontroller being an integrated circuit having four out of its eight pins electrically connected to said active connections of said four buttons, two pins connected to said power supply, one of the latter two being also connected to the ground connections of all four buttons, one pin connected to said electronic relay and one pin connected to a reference frequency, said integrated circuit producing at least two different duty cycles corresponding to said high and low duty cycles.

5. A switching apparatus as defined in claim 3, wherein said switch junction box is a conventional switch junction box used in most of buildings.

6. A switching apparatus as defined in claim 2, further comprising a remote means for transmitting an electromagnetic signal, said electronic circuit further comprises a receiver means adapted to be activated upon reception of said electromagnetic signal, said receiver means being electrically connected in parallel to one of said buttons.

7. A switching apparatus as defined in claim 6, wherein said electromagnetic signal is a radio frequency (RF) wave signal and said receiver means is electrically connected in parallel to said "fast flash" button.

8. A switching apparatus as defined in claim 2, wherein said electronic circuit being adapted to be connected to a plurality of external household electronic accessories all electrically connected in parallel to one of said buttons.

9. A switching apparatus as defined in claim 8, wherein one of said external household electronic accessories is an alarm system and said system is electrically connected in parallel to said "fast flash" button.

10. A switching apparatus as defined in claim 9, wherein said control switch further has a plurality of additional buttons adapted for selecting a personal access code for comparison against a code programmed within said electronic circuit to enable possible activation of said apparatus upon activation of said system.

11. A switching apparatus as defined in claim 2, wherein said control switch further has a plurality of additional buttons adapted for selecting a personal access code for comparison against a code programmed within said electronic circuit and proper activation of both of said "fast flash" and "slow flash" buttons of said apparatus.

* * * * *

UNITED STATES PATENT AND TRADEMARK OFFICE

CERTIFICATE OF CORRECTION

PATENT NO. : 6,262,653 B1
DATED : July 17, 2001
INVENTOR(S) : Umberto Pietrinferno It is certified that error appears in the above-identified patent and that said Letters Patent is hereby corrected as shown below:

Title page,
Items [12] and [75], "Pietriferno" should read as -- Pietrinferno --;
Insert -- [73] Assingee: Sherley Pietrinferno, Ste-Theresa-de-Blainville, QBC, (CA) --.

Signed and Sealed this

Sixteenth Day of September, 2003

JAMES E. ROGAN
*Director of the United States Patent and Trademark Office*